United States Patent [19]

Lewis

[11] 4,194,826

[45] Mar. 25, 1980

[54] SYSTEM FOR DEVELOPING HEAT RESPONSIVE FILM

[75] Inventor: Gary D. Lewis, St. Clairs Shores, Mich.

[73] Assignee: Energy Conversion Devices, Inc., Troy, Mich.

[21] Appl. No.: 939,367

[22] Filed: Sep. 5, 1978

[51] Int. Cl.[2] ..... G03D 13/00

[52] U.S. Cl. ..... 354/299; 355/27; 219/216

[58] Field of Search ..... 354/299; 219/216, 491, 219/492, 494; 346/76 R; 355/27, 19, 28; 96/48 HD

[56] References Cited

U.S. PATENT DOCUMENTS

| | | | |
|---|---|---|---|
| 3,566,151 | 2/1971 | Wilburn | 219/492 X |
| 3,966,317 | 6/1976 | Wacks et al. | 355/19 |

*Primary Examiner*—L. T. Hix
*Assistant Examiner*—William B. Perkey
*Attorney, Agent, or Firm*—Wallenstein, Spangenberg, Hattis & Strampel

[57] ABSTRACT

The length of time a heat source is applied to a heat responsive film to develop the same is controlled electrically by a control circuit which repeatedly samples the temperature of the heat source when it is applied to the film beginning with the instant the heat source is applied thereto. Means are provided which computes a running average temperature of the heat source during the various temperature sampling times over a progressively varying period beginning with the instant the heat source is applied to the film and computes from a temperature which is a function of the running average temperature over said period the desirable exposure time from a formula which is or approximates the exposure time versus assumed constant temperature curve recommended by the film manufacturer. The control circuit further includes timing means which provides an indication of the progressively increasing time duration between the beginning of the exposure period and the particular instant of time involved, and comparison means which compares the time measured by the time measuring means and the time computed from said formula. The heat source is removed from the film when the comparison means indicates that the time indicated by the time measuring means and the time computed from said formula correspond.

4 Claims, 3 Drawing Figures

SYSTEM FOR DEVELOPING HEAT RESPONSIVE FILM

BACKGROUND OF THE INVENTION

The present invention relates to the development of thermally responsive films and has its most important application to fine grain, high-resolution, organosilver photorecording mediums, commonly called dry silver films. Such films are disclosed in U.S. Pat. No. 3,152,903 and 3,152,904 assigned to the Minnesota Mining and Manufacturing Company. The manufacturers of these films commonly publish for each film a curve which shows the recommended development times at various assumed constant temperatures applied to the films. While satisfactory film development also occurs where the film temperature deviates a small amount, like plus or minus ½° C. from the assumed constant development temperature, such is not generally the case for temperature deviations of the order of magnitude of several degrees centigrade from the desired control temperature.

Heat for developing these films is most conveniently applied to the films by a heat-applying metal plunger having a current carrying heating element therein. The plunger is moved into engagement with the film for a desired developing period. It was unexpectedly found that even when the current in the heating element was constant, the temperature of the film engaging end face of the plunger varied quite substantially even over a period of time as little as several seconds during which the plunger is normally applied to the film. These fluctuations, which are substantially beyond ½° C., are believed to be caused by moving air currents adjacent the plunger and film. Temperature fluctuations are also caused by variations in the line voltage supplying current to the heating element in the plunger and the humidity and room temperature conditions. The effect of the variables involved on the plunger end face temperature is especially pronounced when the mass of the plunger is relatively small. While a temperature controller can be provided for controlling the current flow in the heating element to maintain roughly a given temperature at the end face of the plunger, such a controller cannot effectively stabilize the plunger end face temperatures under carrying air current or heater current conditions because there is a time lag between an increase or decrease in current fed to the heating element and the effect such current change has on the temperature at the end face of the plunger. It is, therefore, practically impossible to keep the temperature of the end face within plus or minus ½° C. in environments where air current or voltage fluctuations occur. Furthermore, a controller which can control temperature within such narrow limits even under slowly varying conditions is a costly piece of equipment.

Accordingly, one of the objects of the invention is to provide a unique film developing system for controlling the time a heat source is applied to a thermally responsive film, like the dry silver films referred to, so that optimum developing times are achieved automatically under heat source temperature fluctuating conditions, like variations in the movement of air currents, and the fluctuation of line voltage, and room temperature and moisture conditions. Another object of the invention is to provide a film developing system as described where the equipment involved is reliable and relatively inexpensive to manufacture.

SUMMARY OF THE INVENTION

In accordance with the invention, the length of time during which the heat-applying plunger is applied to the film is controlled by a unique electrical control circuit responsive to the actual, unpredictable, temperature conditions on the end face of the plunger. Thus, instead of attempting to maintain the temperature of the end face of the plunger within small limits like ½° C. above or below a given temperature and applying the plunger to the film for a fixed predetermined time period recommended by the film manufacturer, the temperature conditions are permitted to vary over much larger acceptable limits. These temperature conditions are repeatedly sampled during the developing period as, for example, at 0.1 second intervals, beginning with the instant of time the plunger is brought into initial contact with the film. A sampling time counter is provided for counting the number of sampling times since the beginning of the controlled variable developing period. Temperature summing means provide a summation of the various temperatures measured during the various sampling times and a computation is performed at or immediately following each sampling time which divides this summation by the number of sampling times indicated by the sampling time counter, so that what is called a "running average" of the temperature on the end face of the heat-applying plunger is always available during the developing period.

The control circuit of the invention further has stored therein an exposure time formula, which may be the formula of the exposure time versus constant temperature curve supplied by the manufacturer or, most preferably, a formula representing a straight line approximation of a limited portion of this curve, where a temperature controller is provided which operates to maintain the temperature at the end face of the heat-applying plunger within practical limits with respect to a given desired temperature like + or −2° C. with respect thereto. In such case, the straight line referred to is tangent to the curve at a point representing the temperature at the mid-point of the range of temperatures over which the controller operates to stabilize temperature at the plunger end face.

In any event, the control circuit using the formula involved continuously computes a developing time based on the running average temperature computed by the control circuit. The control circuit further includes timing means which indicate the time which has elapsed since the plunger was initially brought into contact with the film and comparison means which compares the time indicated by the timing means and the last computed desired exposure time and effects the withdrawal of the plunger from the film when the computed exposure time corresponds to the indication of the timing means.

The present invention thus provides in a simple and reliable manner a system for properly developing a heat responsive film without the necessity for maintaining the temperature of the heat source involved within very close tolerances, and which operates reliably despite slowly or rapidly varying temperature fluctuations which occur at the interface between the heat source and the film.

The present invention is to be contrasted, for example, to the heat exposure time control system disclosed in U.S. Pat. No. 3,234,409 granted Feb. 8, 1966, which discloses a system for controlling the time for heating a sterilization chamber. In this control system, the sterilization period is determined by the time required for rotating a control cam a given distance through a clutch. The clutch is driven by a synchronous motor which is intermittently energized for periods determined by the temperature conditions of the sterilization chamber. The motor energizing periods are controlled by a bellows-controlled bi-metallic strip, controlling contacts shunting the motor and heated by a heater connected in parallel with the motor. The operating temperature of the bi-metallic strip varies with the temperature conditions of a bellows unit exposed to the temperature of the sterilization chamber. While this control system responds to the potentially varying temperature conditions in the sterilization chamber by integrating the effects of these varying temperature conditions, this control system is obviously different from the present invention and is not suitable for controlling the developing time of dry silver films and the like where the temperature conditions monitored can vary rapidly over a period of several seconds and where the developing periods last only a short period, generally substantially under 10 seconds.

DESCRIPTION OF EXEMPLARY EMBODIMENT OF THE INVENTION

Figure 1:
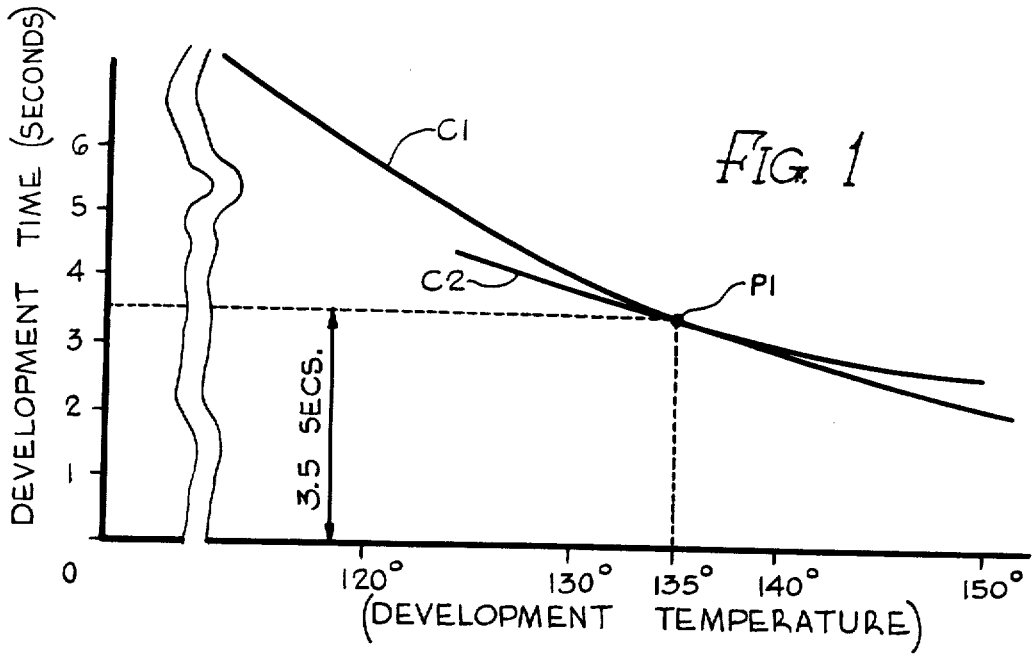
FIG. 1 shows the curve of exposure time versus an assumed constant developing temperature for a dry silver film as recommended by the manufacturer thereof, and a straight line tangent to a point on the curve which represents an approximation of a limited portion of the curve over a narrow range of temperatures.

Refer now more particularly to FIG. 1 which shows a curve C1 supplied by the manufacturer of a given dry silver film which gives the recommended development time of such a film for various assumed constant temperatures applied to an exposed film to produce an image of desired optical density for an assumed light intensity. The curve C1 shows that where the developing temperature is 135° C. the optimum developing time is 3.5 seconds. As previously indicated, the developing temperature may vary above or below the 135° C. temperature by a small amount, like about + or −½° C., without seriously adversely affecting the image quality produced by the developing process.

Figure 2:
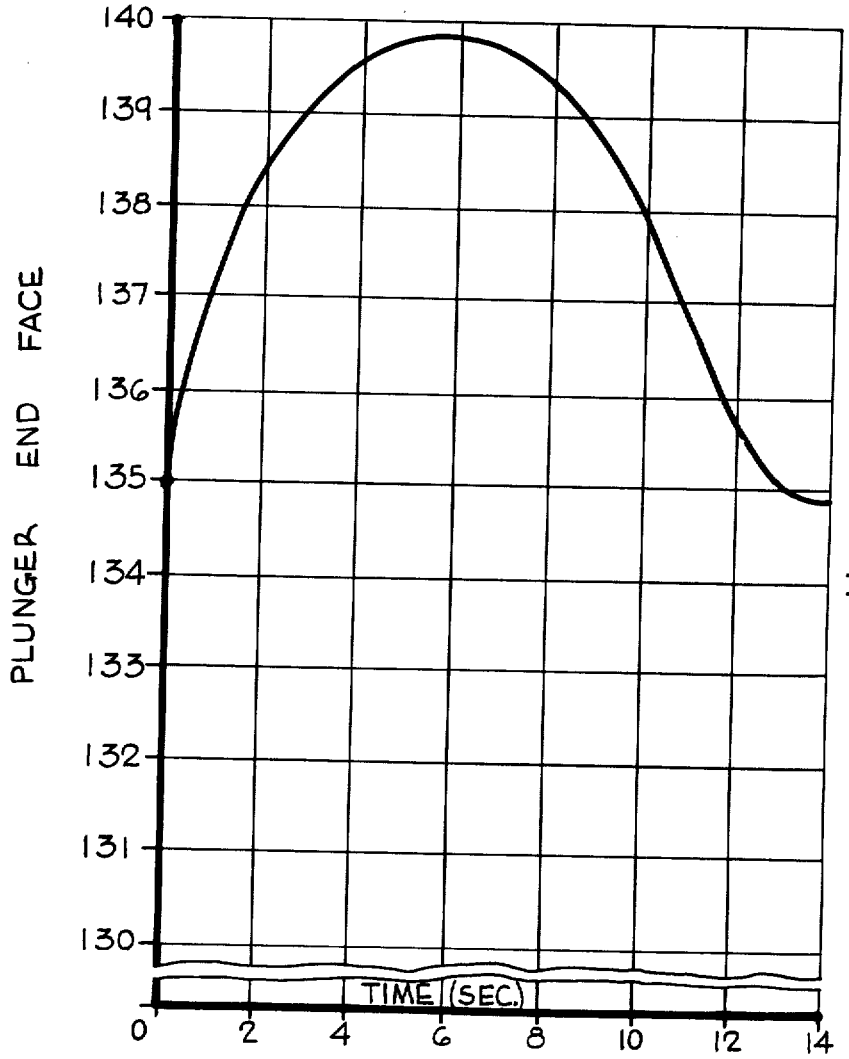
FIG. 2 are waveforms illustrating an exemplary variation of the end face temperature of a heat applying plunger applied for several seconds to a dry silver film, which temperature variations are believed due to fluctuating air currents moving against the film and plunger.

As previously indicated, it is extremely difficult to maintain the temperature of a heat source applied to the film involved within such narrow temperature limits for even a 3.5 second interval. Frequently, varying air currents flowing against the heat source and/or the film create temperature fluctuations substantially exceeding the temperature limits of about ½° C. above and below the desired developing temperature. FIG. 2 shows waveforms illustrating an actual fluctuation in the temperature of a heat source applied to a dry silver film believed due to fluctuations in air currents flowing against the heat source and the film.

Figure 3:
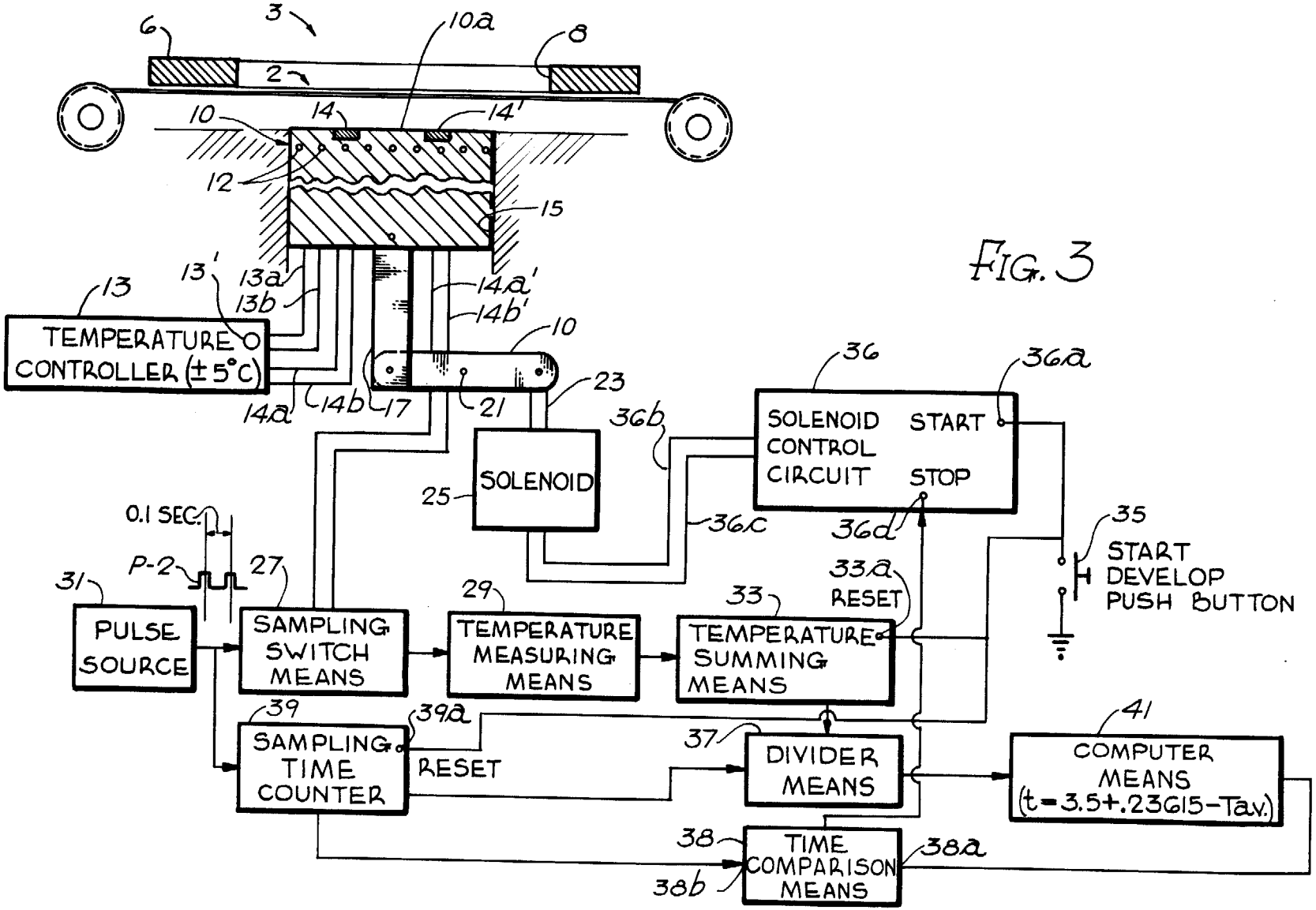
FIG. 3 is a partially schematic and partially block diagram of an examplary film developing system of the invention, and which includes a developing time control circuit which utilizes the formula for the straight line shown in FIG. 1 to control the operation of the control circuit.

Refer now to FIG. 3 which illustrates the unique developing time control system of the present invention which provides automatically an optimum developing time even under rapidly varying developing temperature conditions like that illustrated in FIG. 2. As there shown, the dry silver film is in the form of a strip 2. While not shown, the strip 2 will extend from a supply reel to a take-up reel. The shaft of the take-up reel would be connected to a film wind control unit which advances the strip intermittently to a developing station 3. The film wind control unit may be part of an imaging system like that disclosed in U.S. Pat. No. 3,966,317 granted June 29, 1976 entitled, "Dry Process Production of Archival Microform Records From Hard Copy."

The strip of dry silver film is shown extending against a backing frame 6 having an aperture 8 therein. The dry silver film strip 2 extends across the aperture 8. Supported on the side of the film facing away from the backing frame is a heat-applying plunger 10 having an end face 10*a* extending over an area representing an exposed frame of the film strip. The plunger has heating elements 12 imbedded therein which are fed with heating current through conductors 13*a* and 13*b* extending from a temperature controller 13. Imbedded in the end face 10*a* of the plunger 10 is a temperature sensing device, like a diode sensor 14, the terminals of which are connected by conductors 14*a* and 14*b* to the temperature controller 13. The temperature controller 13 may be a conventional piece of equipment which responds to the temperature sensed by the diode sensor 14 by maintaining the temperature of the end face 10*a* generally within the range of + or −2° C. of a given temperature value set by a temperature setting control 13*a* forming part of the temperature controller 13.

The plunger 10 is supported within a suitable guideway 15 for movement between one extreme position where it is spaced substantially from the film 2 and another extreme position where it presses against the portion of the film 2 within the backing frame opening 8. Pivotally connected to the plunger 10 is one end of a support arm 17 whose opposite end is pivotally connected to the outer end of a lever 19 pivotally supported at a point 21 between the ends thereof. The inner end of the lever 19 is pivotally connected to the armature 23 of a solenoid 25. When the solenoid 25 is de-energized, the plunger 10 is supported in its position where it is substantially spaced from the film 2. When the solenoid 25 is energized, the lever 19 is moved by the solenoid armature 23 in a direction to drive the heated plunger end face 10*a* against the film 2 to initiate the development thereof. The control circuit now to be described will de-energize the solenoid 25 to cause the separation of the plunger 10 from the film 2 to terminate the developing operation.

Imbedded in the end face 10*a* of the plunger 10 is another diode sensor 14'. Conductors 14*a*'14*b*' extend from the diode sensor 14' to temperature sampling switch means 27 which periodically, such as every 0.1 seconds, connects the diode sensor 14' to temperature measuring means 29. The switching rate of the sampling switch means 27 is controlled by a pulse source 31 which generates timing pulses P2 separated by 0.1 second intervals in the exemplary circuit being described. Each such pulse fed to the sampling switch means 27 momentarily couples the diode sensor 14' to the temperature measuring means which responds to the diode sensor by developing a digital signal indicative of the value of the temperature on the end face 10*a* of the plunger 10 when sampling switch means 27 couples the diode sensor 14' thereto.

The digital signal output of the temperature measuring means 29 is fed to a temperature summing means 33 which sums the various temperature values indicated by the temperature measuring means 29 each time the temperature of the end face 10*a* is sampled by closure of the sampling switch means 27. The accumulated value in the temperature summing means 33 is reset to 0 each time a reset signal is fed to a reset input terminal 33*a* of the temperature summing means 33. This reset signal may be generated in any suitable way. As illustrated, it is generated by feeding ground potential to this terminal when a start develop push button 35 is momentarily depressed. The start develop push button 35 is also connected to a "start" input terminal 35*a* of a solenoid control circuit 36. The solenoid control circuit feeds energizing voltage to the solenoid 25 through power conductors 36*b*-36*c* extending to the solenoid 25. The solenoid control circuit 36 has a "stop" terminal 36*d* which de-energizes power conductors 35*b*-36*c* when the "stop" terminal 36*d* receives a control pulse from the output of a time comparison means 38.

A running average of the temperature of the end face 10*a* of the plunger 10 is computed over a progressively increasing period beginning with the instant the plunger 10 is brought into contact with the film 2 by a divider means 37 which divides the accumulated temperature value measured by the temperature summing means 33 by the number of sampling times which produced such accumulated value. Accordingly, a sampling time counter 39 is provided which counts the output pulses P2 generated by the pulse source 31. The sampling time counter 39 has a reset terminal 39*a* which, upon receipt of a ground potential signal, resets the count stored in this counter to 0. Accordingly, the reset terminal 39*a* is connected to the start develop push button 35.

The output of the divider means 37 representing the running average of the sampled temperatures at the end face 10*a* of the plunger 10 is fed to computer means 41 in which is stored a formula for continuously computing a desired exposure time from the running average temperature value computed by the divider means 37. This formula is most advantageously the formula for the straight line C2 (see FIG. 2) which is tangent to the point P1 on the curve C1. It can be seen from FIG. 1 that for temperatures 2° C. above or below the control temperature at point P1, the straight line is reasonably close to the curve C1 so that the maintenance of the temperature of the end face 10*a* within + or −2° C. of the center control temperature of 135° C. will enable the formula represented by the curve C2 to approximate the curve C1 in the vicinity of the point P1 thereof. The use of a straight line formula rather than the formula for the more complex curve C1 is desirable only from the standpoint of minimizing the cost and complexity of the computer means 41.

For the particular curve C1 illustrated, the formula for the curve C2 is as follows:

$$t = 3.5 + 0.23\ (135\text{-Tav})$$

where Tav is the running average temperature computed by the divider 37.

The computation made by the computer means 41 is fed to one input 38*a* of a time comparison means 38 having a second input 38*b* to which is fed an output of the sampling time counter 39 which indicates the time interval between the initiation of the developing process and the particular instant of time involved. The output of the sampling time counter 39 fed to the time comparison means 38 is indicated in terms of the number of 0.1 second intervals which have occurred since the plunger 10 was brought into initial contact with the film 2. When the signals fed to the input terminals 38*a* and 38*b* of the time comparison means correspond, the time comparison means 38 feeds a control signal to the "stop" terminal 36*d* of the solenoid control circuit 36, which terminates the developing period. When a new development operation is to be initiated (which occurs after the film strip 2 is advanced one frame length from its previous position), as previously indicated, resetting signals are fed to the temperature summing means 33 and the sampling time counter which reset the numerical data stored therein to zero.

It is apparent that the various functional units represented by the boxes in FIG. 3 and just described as sampling switch means, temperature measuring means, temperature summing means, divider means, computer means, sampling time counter, the comparison means, and solenoid control circuit may be conventional and well-known electrical components whose circuitry need not be here described. However, the functions performed by some of these units may also be performed by a programmed computer and the software forming a part thereof.

The present invention has thus provided an extremely reliable and simple control system for determining the optimum developing time for a heat responsive film where the temperature of the heat source applied thereto may fluctuate during the developing period.

It should be further understood that modifications may be made to the preferred control system illustrated in the drawing without deviating from the broader aspects of the invention.

I claim:

1. In a film developing system for developing a heat responsive film where the desired time of exposure of the film to a heat source is defined by a given formula which is a function of an assumed constant temperature applied to the film, said system including a source of heat to be applied to the film, and heat source applying means for applying said heat source to said film for a limited developing period, the improvement in control means for controlling the time said heat source is applied to said film, said control means comprising: sampling means for repeatedly sampling the temperature of said heat source when it is applied to said film beginning with the time the heat source is applied thereto, average temperature measuring means responsive to said sampling means for providing a measurement of the running average temperature of said heat source during the temperature sampling times over a progressively varying period beginning with the time said heat source is applied to the film, computing means for computing the theoretically desirable exposure time from said given formula where the temperature value used in the calculation is a function of the running average temperature measured by said average temperature measuring means, time measuring means for providing a measure of the time duration between the beginning of said period when said heat source is applied to said film and the particular instant of time involved, time comparison means responsive to the time measured by said time measuring means and the time computed from said given formula by said computing means, and means responsive to said time comparison means for removing said heat source from said film when said time measurement of said time measuring means and computing means reach a given degree of correspondence.

2. The film developing system of claim 1 wherein there is provided temperature controlling means for keeping the temperature of said heat source within a given limited range of temperature values which, however, are beyond that required to provide proper development of the film for the formula computed exposure time for a temperature centered within said temperature range.

3. The film developing system of claim 2 wherein said formula is a straight line approximation of a limited portion of the actual exposure time versus temperature curve at the point on said curve where the assumed constant temperature is at or near the center of said range of temperature values.

4. The film developing system of claim 1, 2, or 3 wherein said average temperature measuring means includes means for summing the temperature of said heat source when said sampling means samples the temperature thereof, sampling time counting means for counting the number of sampling times effected by said sampling means since the heat source was first applied to the film, and means for providing a measurement of the summation of temperatures indicated by said average temperature measuring means divided by the number of sampling times indicated by said sample time counting means.

* * * * *